US005441470A

United States Patent [19]

Chen

[11] Patent Number: 5,441,470

[45] Date of Patent: Aug. 15, 1995

[54] HEIGHT-ADJUSTING DEVICE FOR AN EXERCISE APPARATUS

[76] Inventor: Tsung-Yu Chen, Ting-Liao No. 23-4, San-Ho Tsun, Shiu-Shang Hsiang, Chia-Yi Hsien, Taiwan

[21] Appl. No.: 329,999

[22] Filed: Oct. 27, 1994

[51] Int. Cl.[6] ..... A63B 21/068

[52] U.S. Cl. ..... 482/96; 482/908; 482/97; 482/102; 482/138

[58] Field of Search ..... 482/95–97, 482/135–138, 142, 102, 908; 74/101, 102, 522, 525; 606/244, 245; 292/257

[56] References Cited

U.S. PATENT DOCUMENTS

| | | | |
|---|---|---|---|
| 4,632,390 | 12/1986 | Richey | 482/96 |
| 4,746,115 | 5/1988 | Lahman | 482/138 |
| 4,768,775 | 9/1988 | Marshall | 482/908 |
| 4,779,864 | 10/1988 | Henson | 482/97 |
| 5,330,405 | 7/1994 | Habing et al. | 482/97 |

FOREIGN PATENT DOCUMENTS

| | | | |
|---|---|---|---|
| 2128885 | 5/1984 | United Kingdom | 482/142 |

*Primary Examiner*—Richard J. Apley
*Assistant Examiner*—Victor K. Hwang
*Attorney, Agent, or Firm*—Knobbe, Martens, Olson & Bear

[57] ABSTRACT

A height-adjusting device for an exercise apparatus has a wedge unit mounted adjustably between a load-carrying member and two lifting levers to lift the load-carrying member. The wedge unit includes a U-shaped inner body sleeved on the load-carrying member and having two opposed first vertical plates and a first bottom plate interconnecting bottom ends of the first vertical plates. Each first vertical plate has first and second end portions. A U-shaped outer body has two opposed second vertical plates disposed outwardly of the first vertical plates, and a second bottom plate interconnecting bottom ends of the second vertical plates. Each second vertical plate has one end portion provided with a roller, another end portion pivoted to a lower section of the second end portion, and a top bearing end. A stop bolt bridges top ends of the second end portions. A lever plate has one end portion with a pair of pivot lugs pivoted to the first end portions, another end portion extending toward the stop bolt, and a locking pin projecting from the lever plate into the load-carrying member when the lever plate bears against the stop bolt. The pivot lugs have bottom cam surfaces engageable with the top bearing ends to immobilize the lever plate.

1 Claim, 5 Drawing Sheets

HEIGHT-ADJUSTING DEVICE FOR AN EXERCISE APPARATUS

BACKGROUND OF THE INVENTION

1. Field of the Invention

This invention relates to a height-adjusting device for an exercise apparatus, more particularly to a height-adjusting device which has a wedge unit positioned adjustably between a load-carrying member and two lifting levers of the exercise apparatus for transmitting a lifting force from the lifting levers to the load-carrying member to cause upward movement of a front end of the load-carrying member for lifting a load.

2. Description of the Related Art

The improvement of this invention is directed to a conventional height-adjusting device which is mounted adjustably between a load-carrying unit and a lifting unit for transmitting a manipulating force from the lifting unit to the load-carrying unit to cause an upward movement of the load-carrying member for lifting load. The conventional height-adjusting device can be moved along the load-carrying unit so as to adjust the arm of force relative to the manipulating force. With the above-described function, the conventional height-adjusting device can be applied to a conventional exercise apparatus in order to improve the conventional exercise apparatus.

The conventional exercise apparatus usually applies a weight stack unit or a frictional piece unit as a resistance supply means. Because the weight stack unit occupies a relatively large part of the conventional exercise apparatus and is quite heavy, it is inconvenient for a user to transport the conventional exercise apparatus. In addition, the weight stack unit can only provide limited resistances for the conventional exercise apparatus. Accordingly, the weight stack unit cannot satisfy the needs of the different users.

The frictional piece unit is a precision and complicated device. Accordingly, when applying the frictional piece unit as a resistance supply means, the conventional exercise apparatus incurs a relatively high manufacturing cost. In addition, the frictional piece unit has to be replaced frequently with a new one after the conventional exercise apparatus is used for a long time.

It is noted that the applicant of this invention has presented a patent application on Jun. 9, 1994 concerning an exerciser, U.S. patent application Ser. No. 08/257,372, which employs a movable and liftable support frame as a resisting force supply unit, and a lever mechanism for lifting the support frame. However, the lever mechanism is still unable to satisfactorily achieve the purposes of simple construction and easy operation for the conventional exercise apparatus.

SUMMARY OF THE INVENTION

Therefore, the main objective of the present invention is to provide a height-adjusting device which is positioned adjustably between a load-carrying member and two lifting levers for transmitting a manipulating force from the lifting levers to the load-carrying member, the height-adjusting device having a simple construction that can be moved easily along the load-carrying member in order to adjust the arm of force relative to the manipulating force.

According to this invention, a height-adjusting device which is used for an exercise apparatus includes a wedge unit. The exercise apparatus includes a frame, an elongated load-carrying member with one end pivoted to the frame, and a pair of parallel lifting levers having first ends thereof pivoted to the frame and lying normally adjacent and below the load-carrying member in a substantially parallel position with respect to the lifting levers. Second ends of the lifting levers are movable upwardly by manipulation of an exerciser. The wedge unit is to be positioned adjustably between the load-carrying member and the lifting levers to incline the load-carrying member with respect to the lifting levers when the lifting levers are moved upwardly. The wedge unit includes a U-shaped inner body, a U-shaped outer body, and a lever plate.

The U-shaped inner body is to be sleeved on a portion of the load-carrying member and has two opposed first vertical plates, and a first bottom plate interconnecting bottom ends of the first vertical plates. Each of the first vertical plates has a first end portion, a second end portion opposite to the first end portion, and a top end extending between the first and second end portions.

The U-shaped outer body has two opposed second vertical plates disposed outwardly of the first vertical plates, and a second bottom plate interconnecting bottom ends of the second vertical plates. Each of the second vertical plates has a first end portion, a second end portion opposite to the first end portion and pivoted to a lower section of the second end portion of a respective one of the first vertical plates, and a top bearing end lower than the top end of a respective one of the first vertical plates.

A roller assembly includes a shaft which is mounted and which extends transversely between the second vertical plates near the second end portions of the second vertical plates and the second bottom plate. The shaft has two end portions extending outwardly of the second vertical plates. The roller assembly further includes a pair of rollers mounted on the end portions of the shaft.

A stop bolt bridges and interconnects the top ends of the first vertical plates at the second end portions of the first vertical plates.

The lever plate has a first end portion provided with a pair of pivot lugs that are pivoted respectively to the first end portions of the first vertical plates at the top ends, a second end portion extending toward the stop bolt, and a locking pin projecting downwardly from the lever plate and being extensible into the load-carrying member when the lever plate bears against the stop bolt. The pivot lugs have bottom cam surfaces which are engageable with the top bearing ends of the second vertical plates respectively to immobilize the lever plate when the lever plate bears against the stop bolt.

BRIEF DESCRIPTION OF THE DRAWINGS

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 2:
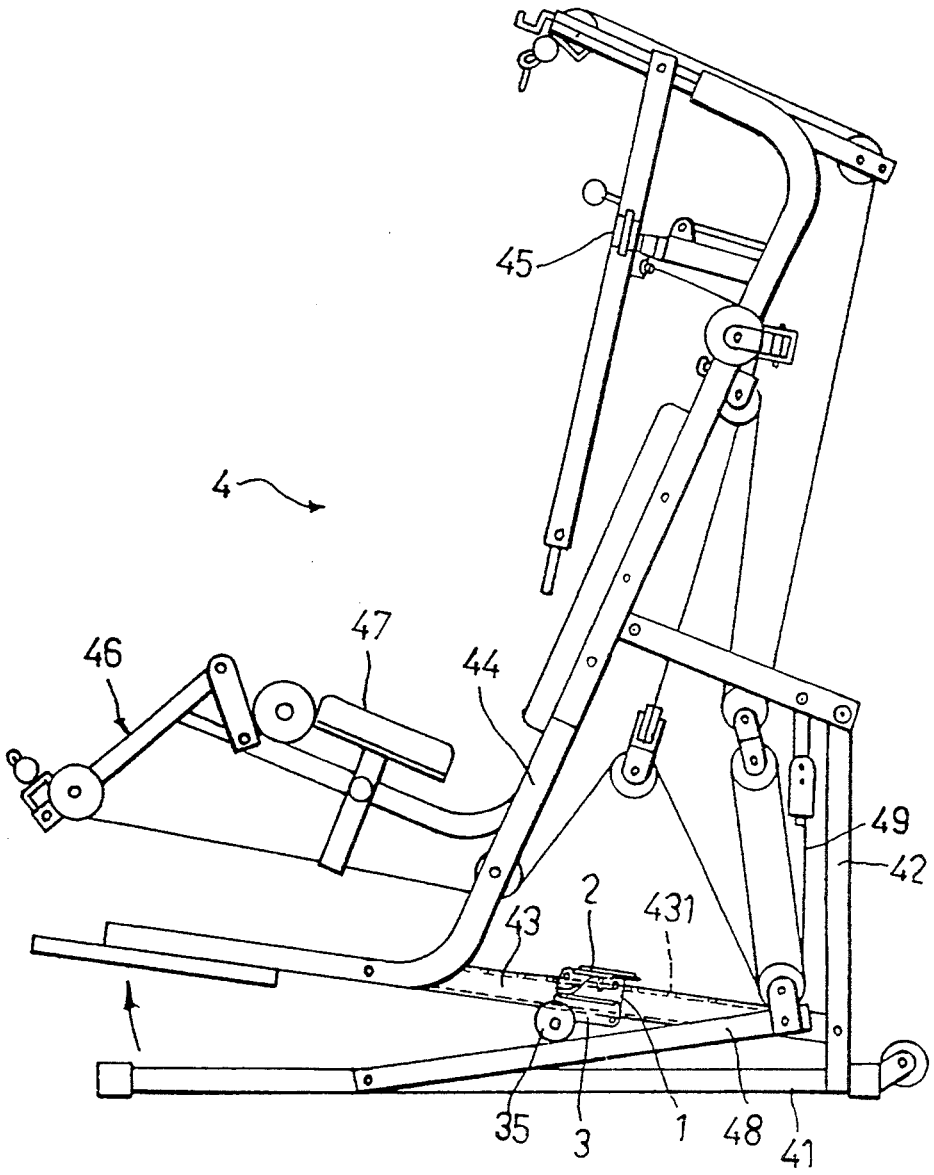
FIG. 2 is a schematic view illustrating how the height-adjusting device is applied to an exercise apparatus in accordance with this invention.

Referring to FIG. 2, the preferred embodiment of a height-adjusting device of this invention is applied to an exercise apparatus 4. It is noted that the height-adjusting device of this invention can be applied not only to the exercise apparatus 4 but also to other lifting devices.

The exercise apparatus 4 has a frame assembly which includes a stationary bottom frame 41 having front and rear end portions, and an upright frame 42 mounted securely to the rear end portion of the stationary bottom frame 41 at a lower end thereof. An elongated load-carrying member 43 has a rear end pivoted to the upright frame 42 and a front end for holding rigidly a movable support frame 44 that carries arm and leg exercise members 45, 46 and a seat 47. The movable support frame 44 serves as a resistance supply means. The load-carrying member 43 has a row of locking holes 431 formed in a top surface thereof. A pair of parallel lifting levers 48 have front ends which are pivoted respectively to two opposite sides of the stationary bottom frame 41, and rear ends which extend toward the upright frame 42 and which are provided to connect with a pulley-and-cord assembly 49 that are associated with the arm and leg exercise members 45, 46. The lifting levers 48 lie normally adjacent and below the load-carrying member 43 and are substantially parallel to the load carrying member 43. The arm or leg exercise member 45, 46 is operable by a user sitting on the seat 47 to lift upwardly the rear ends of the lifting levers 48 via the pulley-and-cord assembly 49 in a known manner so as to move upwardly the movable support frame 44.

Figure 1:
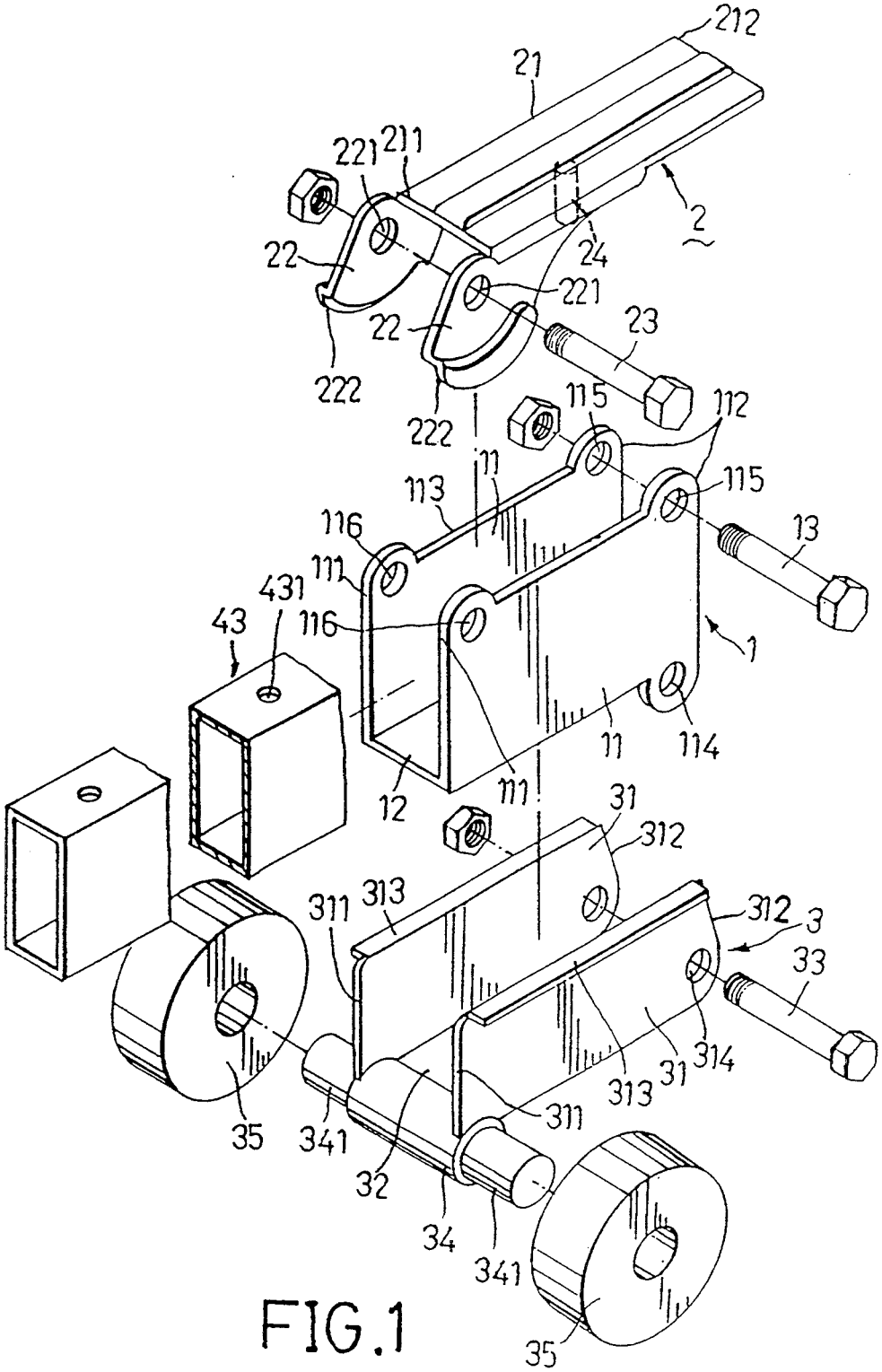
FIG. 1 is an exploded view of a height-adjusting device according to the preferred embodiment of this invention.

Referring to FIGS. 1 and 2, the height-adjusting device includes a wedge unit which is positioned adjustably between the load-carrying member 43 and the lifting levers 48 to incline the load-carrying member 43 with respect to the lifting levers 48 when the lifting levers 48 are moved upwardly. The wedge unit includes a U-shaped inner body 1, a locking unit 2 and a U-shaped outer body 3.

Figure 3:
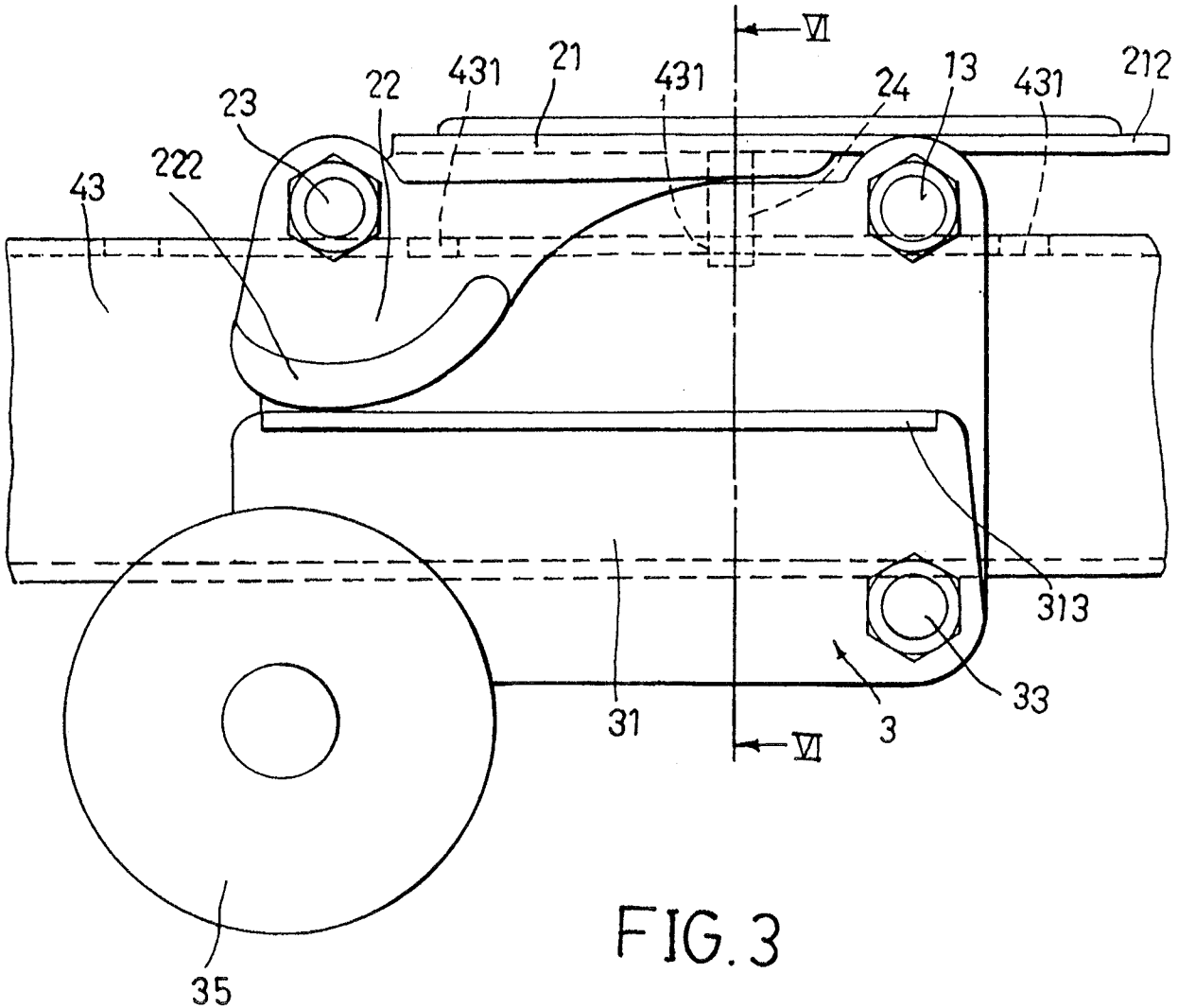
FIG. 3 is a schematic view illustrating how the height-adjusting device is positioned on a load-carrying member of the exercise apparatus in accordance with this invention.
Figure 4:
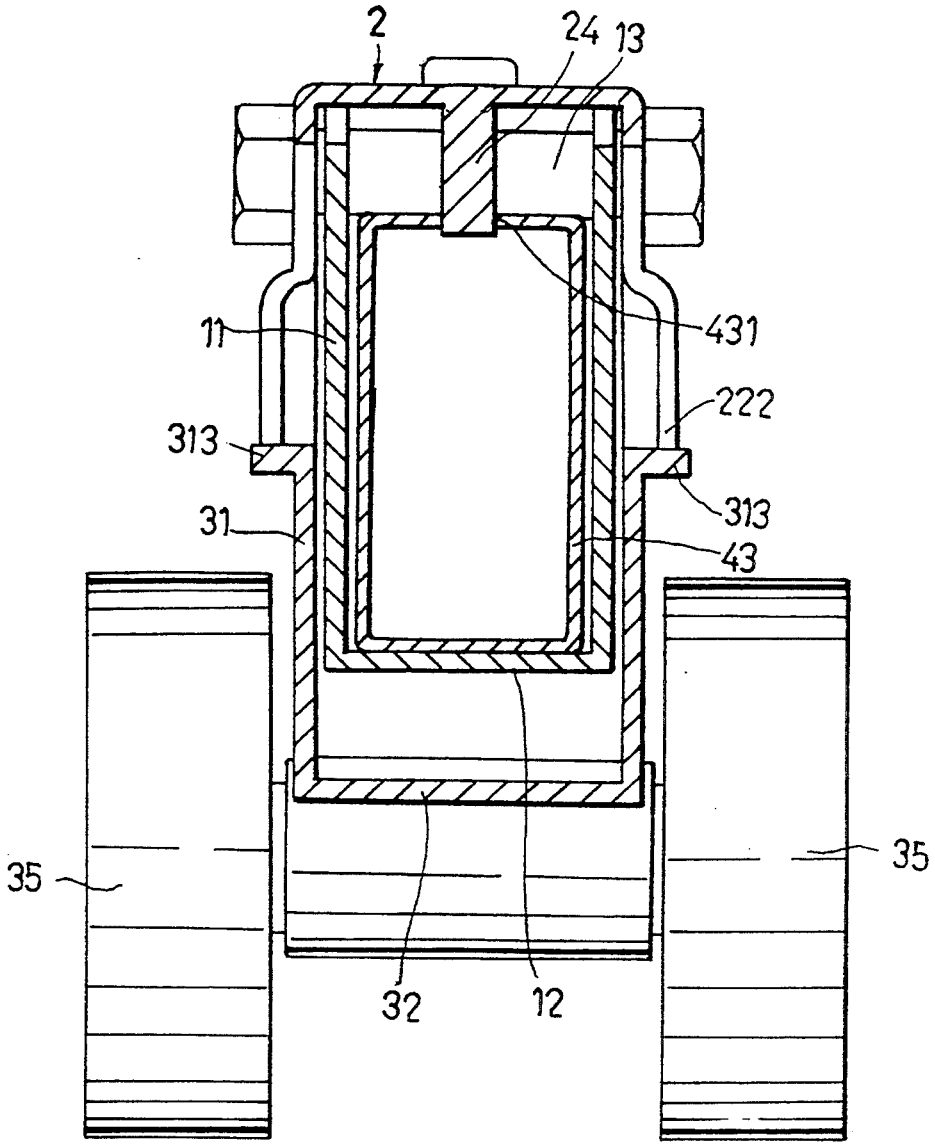
FIG. 4 is a sectional view, taken along the line VI—VI of FIG. 3, illustrating the combination of the height-adjusting device and the load-carrying member according to this invention.

Referring to FIGS. 1 and 3, the U-shaped inner body 1 is sleeved on a portion of the load-carrying member 43 and has two opposed first vertical plates 11, and a first bottom plate 12 interconnecting bottom ends of the first vertical plates 11. Each of the first vertical plates 11 has a first end portion 111, a second end portion 112 opposite to the first end portion 111, and a top end 113 extending between the first and second end portion 111, 112. The first bottom plate 12 abuts against a bottom surface of the load-carrying member 43 (see FIG. 4). A stop bolt 13 extends through a pair of aligned holes 115 which are formed in the top ends 113 at the second end portions 112 of the first vertical plates 11. Since the stop bolt 13 bridges and interconnects the top ends 113 of the first vertical plates 11, the stop bolt 13 can keep the inner body 1 on the load-carrying member 43.

The U-shaped outer body 3 has two opposed second vertical plates 31 disposed outwardly of the first vertical plates 11 (see FIG. 4), and a second bottom plate 32 interconnecting bottom ends of the second vertical plates 31. Each of the second vertical plates 31 has a first end portion 311, a second end portion 312 opposite to the first end portion 311, and a top bearing end 313 lower than the top end 113 of a respective one of the first vertical plates 11. The second end portions 312 of the second vertical plates 31 are pivoted respectively to lower sections of the second end portions 112 of the first vertical plates 11 by means of a pivot bolt 33 which extends through two pivot holes 314 on the second vertical plates 31 and through two pivot holes 114 (only one is shown) on the first vertical plates 11.

A roller assembly includes a shaft 34 which is mounted and which extends transversely between the first end portions 311 of the second vertical plates 31 adjacent to the second bottom plate 32. The shaft 34 has two end portions 341 extending outwardly of the second vertical plates 31. The roller assembly further includes a pair of rollers 35 which are mounted respectively on the end portions 341 of the shaft 34 and which rest normally and respectively on the lifting levers 48 (see FIG. 5).

The locking unit 2 includes a lever plate 21 which has a first end portion 211 provided with a pair of pivot lugs 22 that are pivoted respectively to the first end portions 111 of the first vertical plates 11 at the top ends 113 by means of a bolt 23 which extends through two pivot holes 221 on the pivot lugs 22 and through two pivot holes 116 on the first vertical plates 11. The lever plate 21 further has a second end portion 212 extending toward and over the stop bolt 23, and a locking pin 24 projecting downwardly from the lever plate 21 into one of the locking holes 431 of the load-carrying member 43 when the second end portion 212 of the lever plate 21 bears against the stop bolt 13 in order to lock the wedge unit on the load-carrying member 43. The pivot lugs 22 have bottom cam surfaces 222 which are engageable with the top bearing ends 313 of the second vertical plates 31 respectively when the lever plate 21 bears against the stop bolt 23.

Referring again to FIGS. 2 and 3, when the lifting levers 48 are moved upwardly by virtue of a manipulating force from the arm or leg exercise member 45, 46 so as to push the outer body 3 upwardly via the rollers 35, the top bearing ends 313 of the second vertical plates 31 depress tightly against the bottom cam surfaces 222 of the pivot lugs 22 to produce frictional force therebetween. The frictional force can bias the pivot lugs 22 toward a direction in which the lever plate 21 is turned to contact against the stop bolt 23 so as to keep the locking pin 24 in the corresponding locking hole 431 of the load-carrying member 43, thereby immobilizing the lever plate 21 so as to position the wedge unit on the load-carrying member 43. At the same time, the inner body 1 can be pushed upwardly by virtue of upward movement of the outer body 3 so as to incline the load-carrying member 43 relative to the lifting levers 48, as shown in FIG. 2. In this way, upward movement of the front end of the load-carrying member 43 can lift the movable support frame 44.

Figure 5:
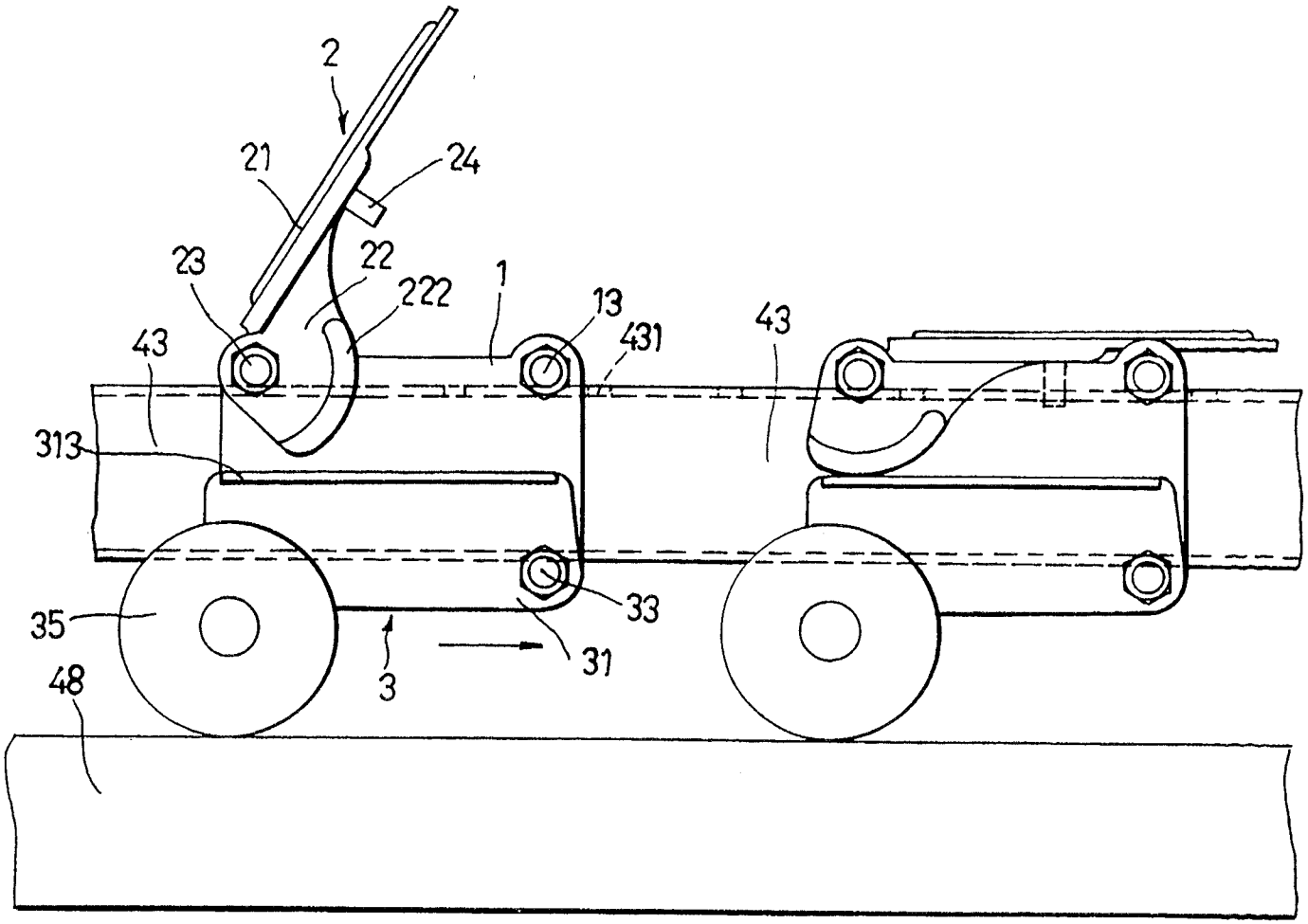
FIG. 5 is a schematic view illustrating how the height-adjusting device is operated to move along the load-carrying member to adjust the arm of force in accordance with this invention.

Referring to FIG. 5, when the lever plate 21 is turned upwardly, the locking pin 24 disengages the corresponding locking hole 431 of the load-carrying member 43, and the bottom cam surfaces 222 of the pivot lugs 22 are removed from the top bearing ends 313 of the second vertical plates 31. In this way, the outer body 3 can be turned slightly upwardly about the pivot bolt 33 to facilitate movement of the wedge unit along the load-carrying member 43 so as to vary the distance of the wedge unit from the rear end of the load-carrying member 43. Accordingly, the arm of force relative to the manipulating force can be easily adjusted.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangement.

I claim:

1. A height-adjusting device for an exercise apparatus, the exercise apparatus including a frame, an elongated load-carrying member with one end pivoted to the frame, and a pair of parallel lifting levers having first ends thereof pivoted to the frame and lying normally adjacent and below the load-carrying member in a substantially parallel position with respect to the lifting levers, second ends of the lifting levers being movable upwardly by manipulation of an exerciser, said height-adjusting device comprising a wedge unit adapted to be positioned adjustably between the load-carrying member and the lifting levers to incline the load-carrying member with respect to the lifting levers when the lifting levers are moved upwardly, wherein said wedge unit includes:

a U-shaped inner body, adapted to be sleeved, on a portion of the load-carrying member, having two opposed first vertical plates, and a first bottom plate interconnecting bottom ends of said first vertical plates, each of said first vertical plates having a first end portion, a second end portion opposite to said first end portion, and a top end extending between said first and second end portions;

a U-shaped outer body having two opposed second vertical plates disposed outwardly of said first vertical plates, and a second bottom plate interconnecting bottom ends of said second vertical plates, each of said second vertical plates having a first end portion, a second end portion opposite to said first end portion and pivoted to a lower section of said second end portion of a respective one of said first vertical plates, and a top bearing end lower than said top end of a respective one of said first vertical plates;

a roller assembly including a shaft which is mounted and which extends transversely between said second vertical plates near said first end portions of said second vertical plates and said second bottom plate, said shaft having two end portions extending outwardly of said second vertical plates, said roller assembly further including a pair of rollers mounted on said end portions of said shaft;

a stop bolt bridging and interconnecting said top ends of said first vertical plates at said second end portions of said first vertical plates;

a lever plate having a first end portion provided with a pair of pivot lugs that are pivoted respectively to said first end portions of said first vertical plates at said top ends of said first vertical plates, a second end portion extending toward said stop bolt, and a locking pin projecting downwardly from said lever plate and being extensible into said load-carrying member when said lever plate bears against said stop bolt, said pivot lugs having bottom cam surfaces which are engageable with said top bearing ends of said outer body respectively to immobilize said lever plate when said lever plate bears against said stop bolt.

* * * * *